United States Patent [19]

Sweatman

[11] 4,422,805

[45] Dec. 27, 1983

[54] METHOD OF GROUTING OFFSHORE STRUCTURES

[75] Inventor: Ronald E. Sweatman, Fountain Valley, Calif.

[73] Assignee: Hughes Tool Company, Houston, Tex.

[21] Appl. No.: 504,241

[22] Filed: Jun. 20, 1983

Related U.S. Application Data

[63] Continuation of Ser. No. 221,946, Dec. 31, 1980, abandoned.

[51] Int. Cl.[3] ..... E02B 17/00; E02D 5/34

[52] U.S. Cl. ..... 405/225; 405/222; 405/227

[58] Field of Search ..... 405/222, 223, 224, 225, 405/227; 264/31, 32

[56] References Cited

U.S. PATENT DOCUMENTS

| | | | |
|---|---|---|---|
| 3,564,856 | 2/1971 | Blount et al. | 405/225 |
| 3,601,999 | 8/1971 | Olsen et al. | 405/225 |
| 3,811,289 | 5/1974 | Bassett | 405/225 |
| 3,832,857 | 9/1974 | Bassett | 405/225 |
| 3,839,872 | 10/1974 | Loire | 405/225 |
| 3,878,687 | 4/1975 | Tragesser, Jr. | 405/225 |
| 4,070,869 | 1/1978 | Williams | 405/225 |

*Primary Examiner*—David H. Corbin

*Attorney, Agent, or Firm*—Robert A. Felsman; Charles D. Gunter, Jr.

[57] ABSTRACT

Submerged cavities such as occur in jacketed pilings in offshore structures are grouted by the sequential use of materials with initially decreasing densities, the heaviest of which is lighter than water, followed by the use of conventional grouting materials of greater density. The first material is quick setting and generally water-immiscible. Water is thus displaced downwardly out of the cavity by the lighter material. The first material is forced to the bottom of the cavity and allowed to set as a plug to support the conventional grouting materials.

3 Claims, 5 Drawing Figures

METHOD OF GROUTING OFFSHORE STRUCTURES

This application is a continuation of application Ser. No. 221,946, filed Dec. 31, 1980, now abandoned.

BACKGROUND OF THE INVENTION

This invention relates to the grouting of cavities which are at least partially submerged in water. More specifically, this invention relates to grouting of offshore or underwater structures, such as drilling platform pilings, both for structural purposes and to prevent erosion.

Previously, considerable difficulty has been experienced in grouting submerged structures and particularly offshore structures. When the structures are located in deep water, the services of divers are often required. Diving around submerged structures in deep water is often hazardous.

The areas of the structures which require grouting are often somewhat irregular in shape and difficult to grout. Many times the resulting grout is deficient in both bond and compressive strength when set. Grout lines were often extended to the bottom of the structure under circumstances where there is risk of damaging or losing them. According to previous proposals, there was considerable risk of the grout escaping from the locations where it was desired, thereby resulting in loss of grout material as well as failure to achieve the desired structural result. In many cases, the grouting was incomplete because of the presence of voids or trapped pockets or channels of water.

SUMMARY OF THE INVENTION

It is therefore an object of the present invention to provide a method of grouting structures which prevents contamination of the grout by water or air pockets.

Another object of the present invention is to provide a grouting method for offshore structures which produces a grout with improved compressive strength and with improved bond strength between the grout and surrounding structure.

Accordingly, the grouting method of the present invention utilizes a generally water-immiscible, quick setting initially fluid material which has a density which is less than that of the water in which the structure is immersed. The initially fluid material is floated on top of the water in the cavity which is to be grouted and it is then forced to the bottom of the cavity, thereby displacing water downwardly. The initially fluid material is allowed to set at the bottom of the cavity, thus forming a plug which serves to support conventional grouting cement slurries which are considerably more dense than water.

A preferred method of grouting according to the present invention involves floating a material which comprises an organic polymeric material on the surface of the water in the cavity which is to be grouted. The organic polymeric material is forced downwardly into the cavity by means of a low density aerated cement slurry which has been aerated to a degree sufficient to reduce its density to less than that of the polymeric material. The aerated cement slurry is pumped into the cavity on top of the polymeric material so as to force the polymeric material downwardly. After the polymeric material has set, a conventional unaerated cement slurry is pumped into the cavity under sufficient pressure to collapse the aerated slurry. The plug of set polymeric material at the bottom of the cavity supports the weight of the conventional cement slurry and the pressure required to collapse the aerated cement slurry.

DETAILED DESCRIPTION OF THE INVENTION

Figure 1:
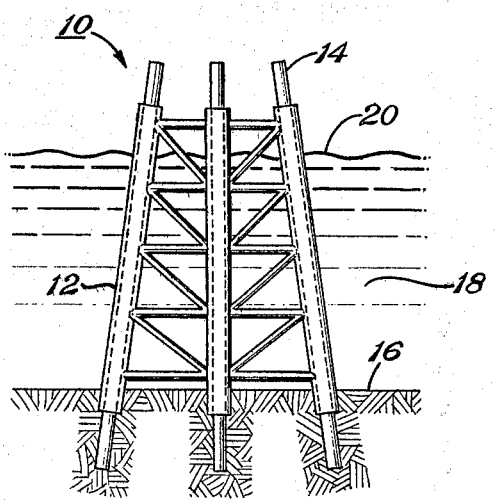
FIG. 1 is a side view of a portion of an offshore structure having jacketed pilings.

Referring now to FIG. 1, an offshore structure is indicated generally at 10. Offshore structure 10 includes a typical jacketed leg including a jacket 12 enclosing a pile 14. The jacket 12 extends from above the surface 20 of the surrounding body of water 18 in which offshore structure 10 is submerged into seabed 16. Pile 14 is driven through jacket 12 into seabed 16 well beyond the lower end of the jacket 12.

Figure 2:
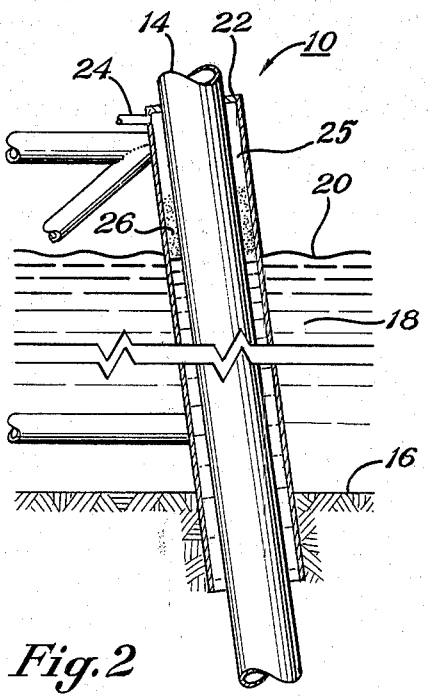
FIG. 2 is a side view partially in cross-section showing a jacketed piling in an initial stage of the grouting operation.

As seen in FIG. 2, the generally annular space or cavity 25 to be grouted between pile 14 and the interior of jacket 12 is closed at the top by plate 22. An injection port 24 is positioned at the top of cavity 25 to permit the injection of various fluid materials into the cavity.

A generally water-immiscible, quick setting, initially fluid material 26 is injected into the cavity 25 through injection port 24 and floats on the surface of water within the cavity (see FIG. 2). Initially fluid material 26 is any generally water-immiscible, quick setting material compatible with the aqueous environment in which the material is employed which is less dense than the surrounding water 18. Suitable initially fluid materials include organic polymeric materials wherein the organic polymeric component is capable of polymerizing to a set condition within approximately one to two hours. Such materials include epoxy resins, phenolformaldehyde resins, and polyester resins. The density of these materials can be lowered by mixing them with perlite, ground plastic, low specific gravity cellular microspheres, plastic beads, and gilsonite. Preferably the organic polymeric material is a water-immiscible epoxy resin which is compatible with the aqueous environment.

The water on which initially fluid material 26 is floating has a density of approximately 8.5 pounds per gallon (ppg). The density of initially fluid material 26 is selected so that it is at least slightly less than the density of the water it is to displace. The density of initially fluid material 26 is preferably less than that of the surrounding water 18 by at least approximately 0.1 ppg.

Figure 3:
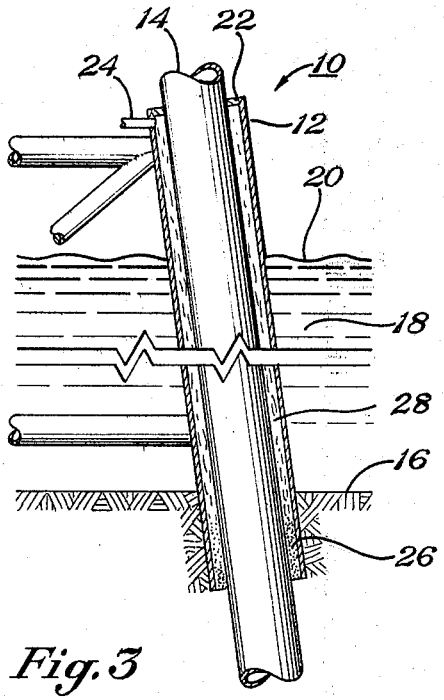
FIG. 3 is a view similar to FIG. 2 at a later stage of the grouting operation.

Although initially fluid material 26 can be forced to the bottom of cavity 25 by gas pressure or any low density liquid or foam, it is preferred to utilize a low density aerated cement slurry. Materials used for the aerated cement slurry include any one or a mixture of Class A to Class J cements which harden or set under water and may be admixed with extenders, fine aggregate and the like, and include settable hydraulic cements. Cement compositions of this type are prepared in the form of a fluid pumpable slurry and are aerated by known methods such as that shown in U.S. Pat. No. 3,119,704 to B. R. Harrell et al, issued Jan. 28, 1964, entitled "Preparation of Aerated Cementitous Products", the disclosure of which is hereby incorporated by reference. FIG. 3 shows a low density aerated cement slurry 28 which has been pumped into cavity 25 through injection port 24 forcing initially fluid material 26 to the bottom of the cavity. The pressure applied to aerated cement slurry 28 is sufficient to force initially fluid material 26 downwardly but is insufficient to collapse the aerated slurry. The density of the aerated cement slurry 28 is less than that of the initially fluid material 26. Preferably, the density of aerated cement slurry 28 is less than the density of initially fluid material 26 by at least approximately 0.1 ppg. The generally water-immiscible nature of initially fluid material 26 prevents water from intermixing with such material or from intermixing with the cement slurry 28 which follows behind.

The relative setting times of initially fluid material 26 and aerated cement slurry 28 are such that the cement slurry 28 is still fluid after material 26 has sufficiently set to support the weight of a much heavier cement slurry. Additives which can be mixed with aerated cement slurry 28 to control the setting time include lignosulfonates, sugars, polymers, salt, potassium chloride, calcium chloride, and sodium silicate.

After material 26 has been allowed to set but while cement slurry 28 is still generally fluid, a conventional unaerated cement slurry 29 having a density in the range of approximately 14 to 18 ppg is pumped into cavity 25 under sufficient pressure to collapse slurry 28.

Figure 4:
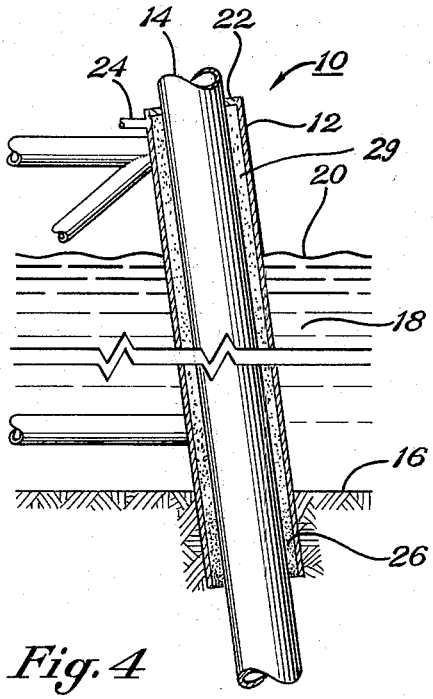
FIG. 4 is a view similar to FIGS. 2 and 3 wherein grouting has been completed.

Elevated pressures in the range of 250–350 pounds per square inch and greater are required to collapse slurry 28. By collapsing slurry 28, its density is increased thereby improving bonding and compressive strength of the grout. The plug of initially fluid material 26 which is now set in the bottom of cavity 25 supports the weight of cement slurry 29 and the pressure required to collapse the aerated slurry. In FIG. 4, initially fluid material 26 has been allowed to set and the aerated cement slurry 28 has been collapsed by forcing a conventional slurry 29 in under pressure.

Because of the pressures that are used in carrying out the invention, the lines leading to injection port 24 are connected to establish the system and the system is then pressure tested with water. During the placement of the initially fluid material 26, the water which is displaced downwardly has to be permitted to escape from cavity 25. To accomplish this, the water in the system is pressurized to the point where it establishes an opening in cavity 25 at about the bottom thereof so that the downwardly displaced water will escape from the cavity without difficulty.

Figure 5:
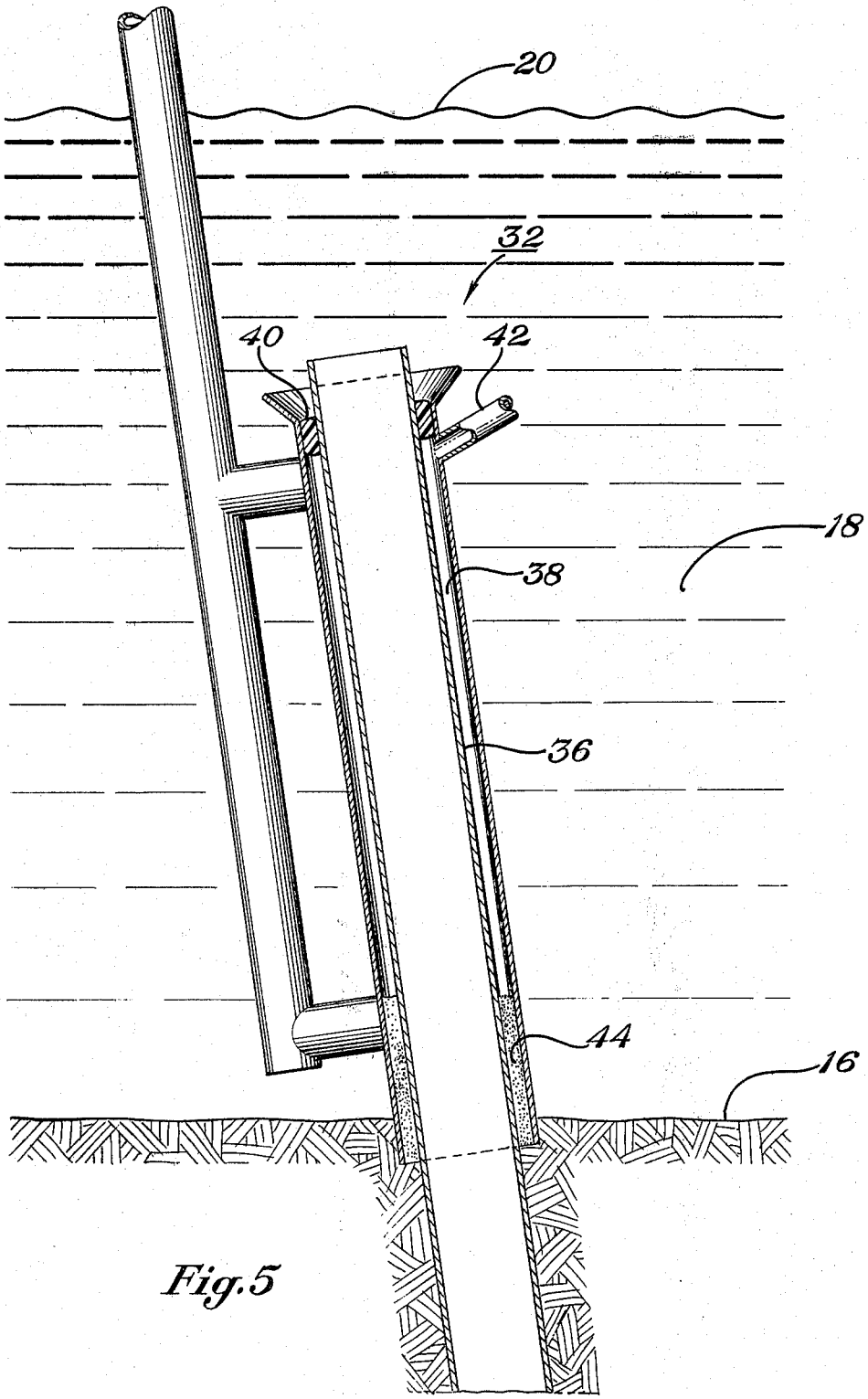
FIG. 5 is a cross-sectional view of a portion of a skirt-pile structure in an offshore location wherein grouting is partially completed.

Referring now to FIG. 5, there is shown a skirt-pile type structure denoted as 32 which differs from the jacketed leg of FIGS. 1–4 in that the top of the skirt 33 is under the surface of the water 20. The cavity of the jacketed pile can ordinarily be closed by welding a plate in place. In the skirt-pile, the top of the cavity is under water and a packing is normally provided between the pile 36 and the skirt 37. The packing shown as 40 in FIG. 5 fills the annular cavity 38 so as to withstand the required pressures. Packing 40 can be a retrievable seal or a conventional inflatable packer.

The cavity 38 is then pressurized with ambient water to test the strength of the packing 40 as well as to establish a channel from the bottom of the annular cavity 38 back to the body of water 18. A generally water-immiscible, quick setting, initially fluid material 44 of the type previously described is then introduced into cavity 38 through injection port 42. Gas, liquid, or foam pressure is applied through port 42 to force material 44 downwardly through annular space 38. As material 44 moves downwardly through the annular space, water is expelled from the cavity 38 through the channel which was previously established when the system was pressurized with ambient water. When material 44 reaches the location illustrated in FIG. 5, it is held in place in that location by gas, liquid, or foam pressure until it sets sufficiently to support the weight of a conventional cement grout having a density ranging from approximately 14 to 18 ppg. The conventional grout is then forced into cavity 38 to fill the cavity. Material 44 may fill all or part of cavity 38 to achieve different bond strength requirements.

It should be apparent from the foregoing that an invention has been provided with significant advantages. The use of an organic polymeric material which floats on the water permits grouting operations to be carried out from the surface and does not generally require the services of a diver. The lightweight polymeric material tends to force all of the water downwardly so that there is no water entrained in the area to be grouted. The polymeric material which floats on the surface of the water tends to follow the contours of the cavity sweeping all of the water in the cavity so that there are no pockets or channels formed in the grout by reason of the presence of water.

Because the organic polymeric material which sets ups and forms a plug in the bottom of the cavity is less dense than water, it does not fall or flow out of the bottom cavity during the grouting operation. Cavities and channels which might occur by water flowing back upward are thereby substantially eliminated. The use of materials which are lighter than water and which have progressively decreasing densities permit the advantages of this invention to be achieved. The grouting which results is substantially void free with good bond and compressive strength.

While it is apparent the invention has been shown in only two of its forms, it should be apparent to those skilled in the art that it is not so limited but is susceptible to various changes and modifications without departing from the spirit thereof.

What is claimed is:

1. A method of grouting an offshore structure having a vertically extending outer jacket and a pile mounted inside of and spaced from said jacket to form a space therebetween comprising:

closing the top of said space;

forcing a generally water-immiscible, quick setting, initially fluid material into said space to displace water downwardly out of said space, the density of said material being less than that of the water it displaces by at least 0.1 pounds per gallon;

forcing a low density aerated cement slurry into said space on top of said material thereby positioning said material proximate the bottom of said space, the density of said aerated slurry being less than that of said material by at least 0.1 pounds per gallon;

allowing said material to set;

pumping a conventional unaerated cement slurry into said space under pressure, thereby collapsing said aerated cement slurry; and allowing the collapsed cement slurry to set.

2. A method of grouting a cavity which is at least partially submerged in water comprising the steps of:

selecting an enclosed cavity having an opening at approximately the bottom thereof;

forcing a generally water-immiscible, quick-setting, initially fluid material into said cavity thereby forcing water downwardly out of said cavity, said material having a density which is less than that of the water it displaces;

forcing a low density aerated cement slurry into said cavity thereby forcing said material downwardly in said cavity to about the level of said opening, said cement slurry having an initial density which is less than that of said material and a setting rate which is slower than that of said materia;

allowing said material to set;

increasing the density of said low density aerated cement slurry by pumping a conventional unaerated cement slurry into said cavity under pressure; and allowing said cement slurry to set.

3. A method of grouting a cavity which is at least partially submerged in water comprising the steps of:

selecting an enclosed cavity having an opening at approximately the bottom thereof;

floating a generally water-immiscible, quick-setting, initially fluid material in said cavity said material having a density which is less than that of the water it floats on and which is more dense than air;

forcing a low density material selected from the group consisting of low density liquids and low density foams into said cavity behind said quick setting material thereby forcing said quick setting material downwardly in said cavity to about the level of said opening while forcing water downwardly out of said cavity, said low density material having an initial density which is greater than air and which is less than that of said quick setting material and a setting rate which is slower than that of said quick setting material;

allowing said quick setting material to harden; and allowing said low density material to harden.

* * * * *